United States Patent [19]

Raymond et al.

[11] 4,069,694

[45] Jan. 24, 1978

[54] RESETTABLE LOCK ASSEMBLY FOR HOTELS, AND THE LIKE

[75] Inventors: James W. Raymond, Newport; James A. Millett, Fountain Valley, both of Calif.

[73] Assignee: James W. Raymond, Costa Mesa, Calif.

[21] Appl. No.: 726,975

[22] Filed: Sept. 27, 1976

[51] Int. Cl.[2] ..... E05B 35/10

[52] U.S. Cl. ..... 70/337; 70/383; 70/364 R; 70/341

[58] Field of Search ..... 70/337–344, 70/364 R, 372, 382–384

[56] References Cited

U.S. PATENT DOCUMENTS

| | | | |
|---|---|---|---|
| 474,783 | 5/1892 | Taylor | 70/337 |
| 3,154,938 | 11/1964 | Cohen | 70/339 X |
| 3,999,413 | 12/1976 | Raymond | 70/364 R |

*Primary Examiner*—Robert L. Wolfe
*Attorney, Agent, or Firm*—Keith D. Beecher

[57] ABSTRACT

A double-barrel double-plug cylindrical lock is provided for hotels, and the like, where changes of occupancy frequently occurs. The lock cylinder is constructed to be of approximately the same size and shape as the prior art lock cylinders, so that the lock of the invention may readily be mounted into existing mortise door hardware to replace existing cylindrical locks. One plug of the lock is intended to be operated by the guests' key; and the other plug is intended to be operated by the maid's key, by an emergency key and by a program key. The guest key may be used to turn the guest plug to a resettable position in which a new guest key may be inserted which sets the guest plug to accept the new key. However, the lock is constructed so that the guest plug cannot be turned to its resettable position unless the emergency key or program key is first inserted in the other plug to turn the other plug to a particular angular position in which the guest plug is able to be turned to its resettable position. Also, the other plug may be turned to a resettable position by the program key, in which the other plug can be reset to accept a new maid's key and a new emergency key. Neither the maid's key nor the emergency key can be withdrawn when the second plug is turned to its resettable position, but the program key can be withdrawn.

11 Claims, 14 Drawing Figures

10
16
17
19
21
23
10

CAM
PLUG
GEAR
34
30
32
2
2
14
12

REAR

RESETTABLE LOCK ASSEMBLY FOR HOTELS, AND THE LIKE

BACKGROUND OF THE INVENTION

The following description will be directed to the use of the double-plug lock of the invention in hotels and the motels. However, it will become evident as the description proceeds that the lock has general utility, for example, in institutions, industrial plants, government facilities, and so on, where changes in the locks are required with some frequency, and where master keying is employed.

Problems have arisen during recent years in preventing theft from hotel and motel rooms due to the unauthorized use of the key issued to guests and maids. Such keys are often lost, stolen, or otherwise find their way into the hands of thieves. The problem is aggravated because the prior art hotel keys normally carry identifying tags which gives the thief the exact information as to the name of the hotel, its address, and the room number to which access may be gained by use of the particular key.

A principal objective of the present invention is to provide a lock which may be readily reset after each occupancy, so that the previous guest's key no longer fits the lock, and so that the lock may be set to accept a new guest key.

The lock to be described is a double-plug type, so that one key may be issued to each guest and a different key may be issued to the maid, and so that the maid's key and the guest's key may be used to operate the lock independently of each other. Precautions are built into the lock, so as to prevent the guests themselves from resetting the locks, this being achieved by the provision of a program key which must first be inserted into th maid's plug of the lock to turn the maid's plug to a position in which the guest plug is released. Only then may the guest plug be turned to its resettable position.

The mechanism included in the individual plugs may be of the type described, for example, in Copending Application Ser. No. 648,176 filed Jan. 12, 1976 and now U.S. Pat. No. 3,999,413. A feature of the lock described in the copending application is the provision of a simple assembly which may reset at will to receive a different key, without the need for any special tools, and merely by turning the lock by the current key to a resettable position, withdrawing the current key, inserting a new key, and turning the lock back to its normal position by the new key. The lock is thereby set so that it cannot be unlocked by the previous key, but it can be unlocked only by the new key.

The individual plugs of the double-plug lock of the invention, like the lock of the copending application, includes an anti-pack feature in the form of a pick bar which engages the tumblers of the lock whenever the plug is turned from a reference position. The pick bar prevents movement of the tumblers unless the plug is in the reference position. This means that unless the proper key is inserted into the lock, when the plug is in its reference position, initially to move the tumblers to their proper positions so as to permit the plug to be turned from the reference position and unlocked, no unlocking operation is possible. This is because the tumblers are immediately locked in their relative positions as set by the inserted key, upon an initial turning of the plug by the key from the reference position.

Another feature of the lock of the invention is that it can be made simply, economically, and on a mass production basis. This is because each lock can be made exactly the same as all others, and each individual lock need not be designed to accept one particular key. Moreover, the purchaser of the lock of the invention may change it to accept a new key, at any time, and without the need for any extraneous tools. However, this cannot be achieved by the guest himself as will be described. Also, the maid's lock cannot be changed, except by a person having access to the program key. Also, as described, the lock of the invention has an advantage in that it can be constructed to have approximately the same size as the prior art mortise cylindrical locks, so that it can easily be mounted into existing door hardware to replace existing cylindrical locks, without the need for costly retrofit operations.

DETAILED DESCRIPTION OF THE ILLUSTRATED EMBODIMENT

Figures 1, 6, 6A:
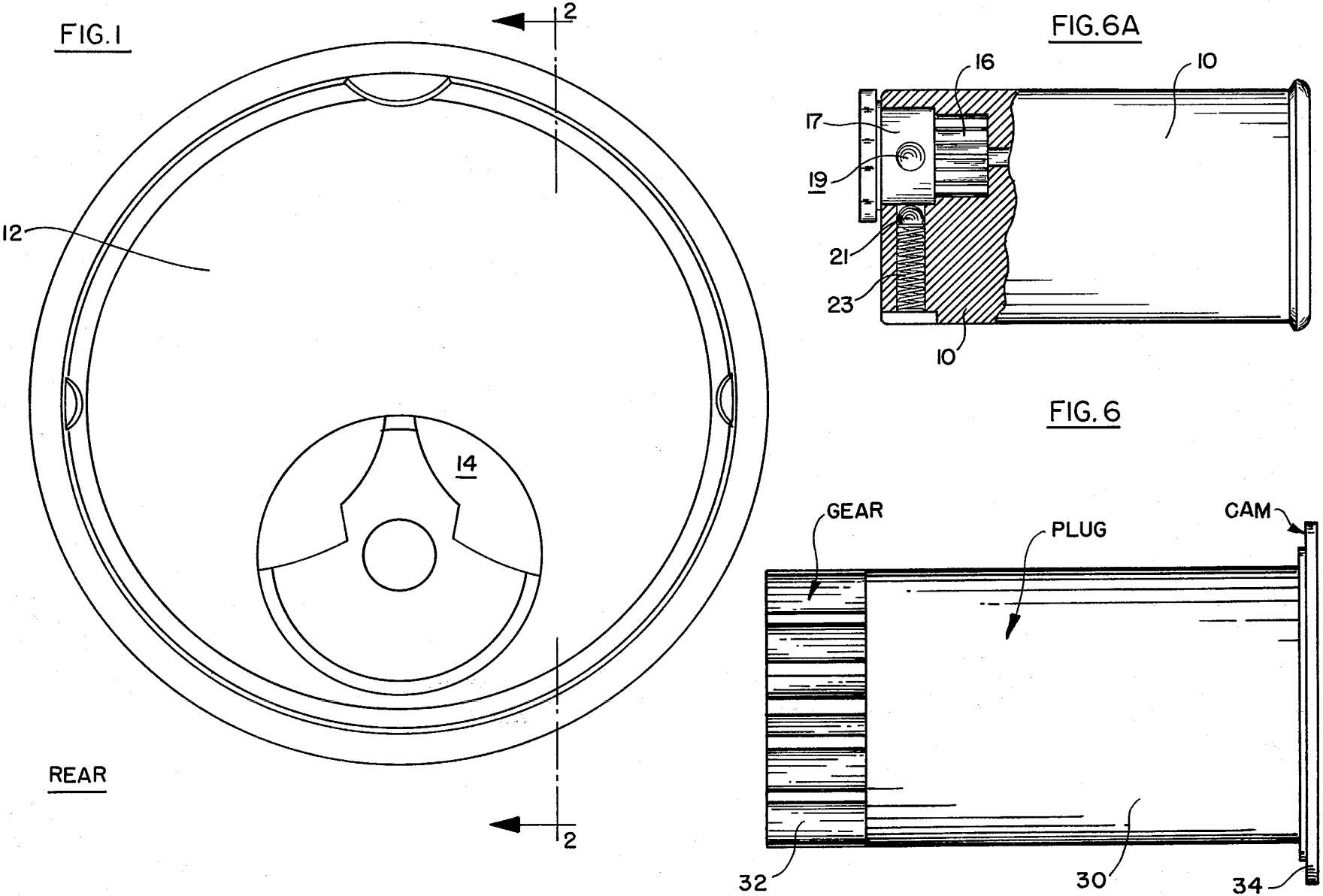
FIG. 1 is a rear view of a double-plug lock constructed in accordance with one embodiment of the invention, and with the internal operating plugs and gears removed.
FIG. 6 is a side view of either one of the operating plugs used in the double-plug lock of the invention.
FIG. 6A is a side view of the lock, partly in section to reveal a spring-loaded ball and detent sub-assembly which is incorporated into the lock.
Figure 3:
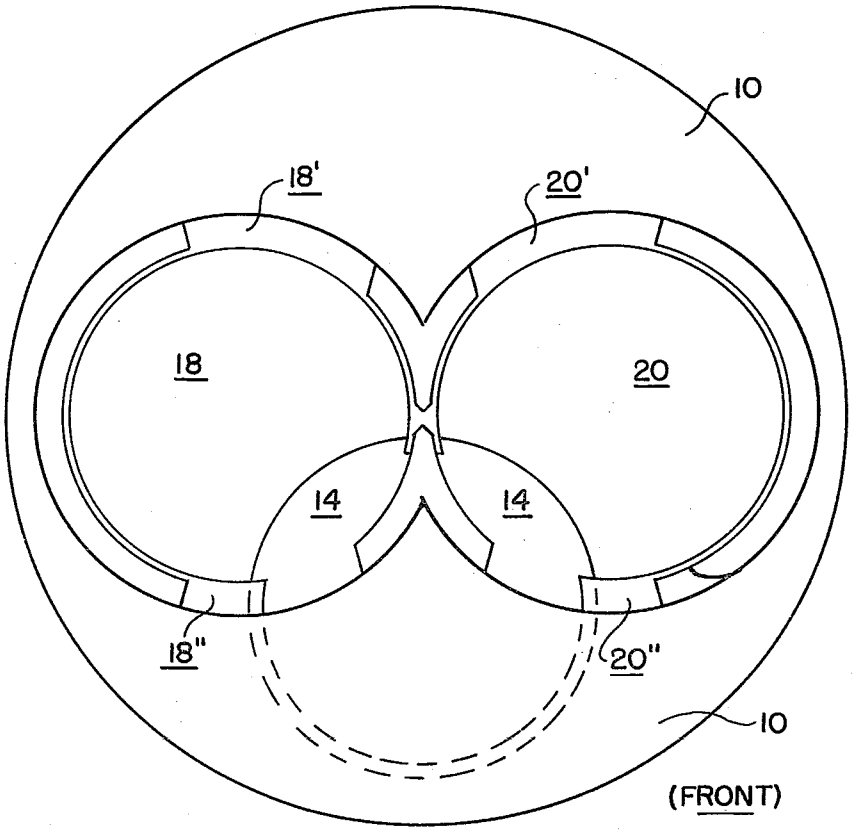
FIG. 3 is a front view of the lock of FIG. 1, with the front mask removed.
Figure 2:
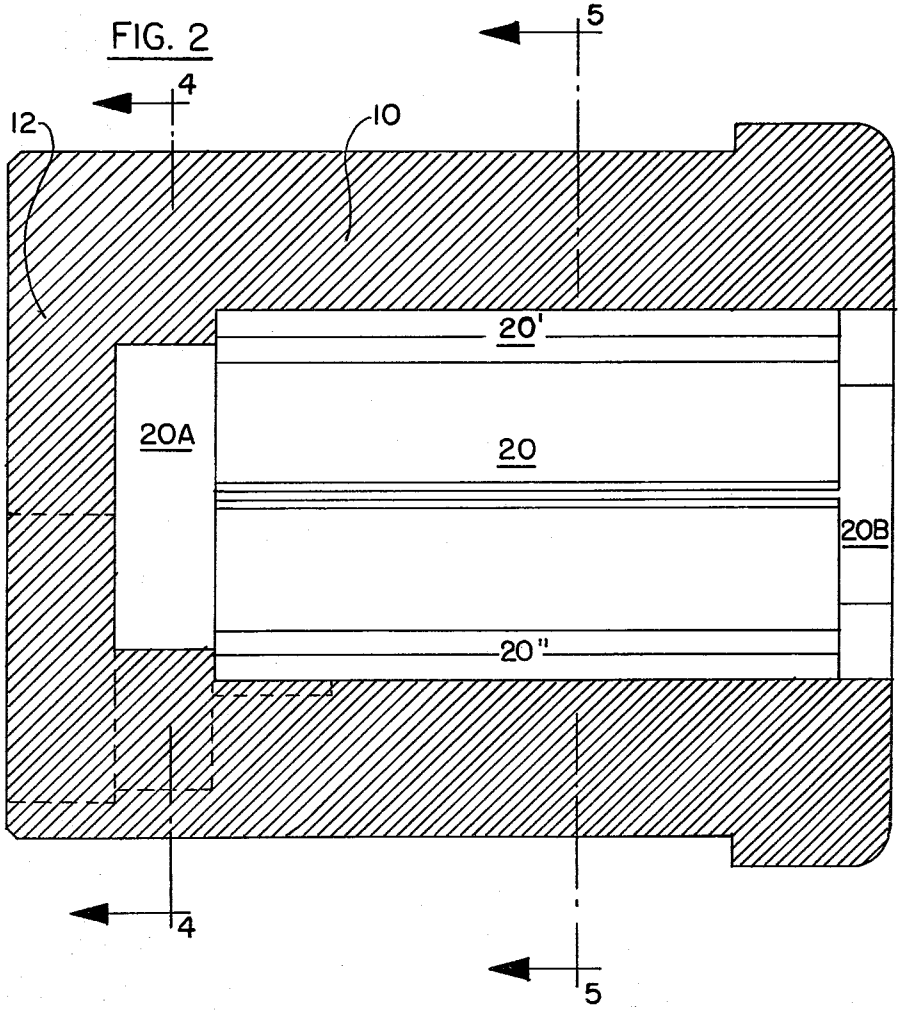
FIG. 2 is a section taken essentially along the line 2—2 of FIG. 1.
Figure 8:
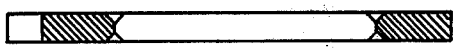
FIG. 8 is a section taken along the line 8—8 of FIG. 7.

As best shown in FIGS. 1, 2, 3, 4 and 5, the double-plug lock of the invention includes a housing 10 of cylindrical configuration, and of a diameter which would permit the housing to be inserted into an existing mortise door hardware so that the double-plug lock of the invention may be used to replace an existing mortise cylindrical lock in the door. As shown in FIG. 1, the housing 10 has a rear wall 12 having a circular opening 14 therein which is intended to receive a gear 16 shown, for example, in FIG. 4A.

The housing also encloses two cylindrical-shaped barrels 18 and 20 which extend inwardly from the front end of the housing 10 to the rear wall 12. Each of the barrels 18 and 20 has a rear compartment, such as the compartment 20A in FIG. 2, and a forward compartment, such as the compartment 20B in FIG. 2. A pair of plugs, such as the plugs 30 in FIG. 6 are inserted respectively into the barrels 18 and 20. Each of the plugs has a rear gear 32 which is received in the compartment 20A, for example, and each of the plugs has a forward cam 34 which is received, for example, in the compartment 20B. The cams are designated 34A and 34B in FIG. 3A, and they have the illustrated configuration.

Figure 3A:
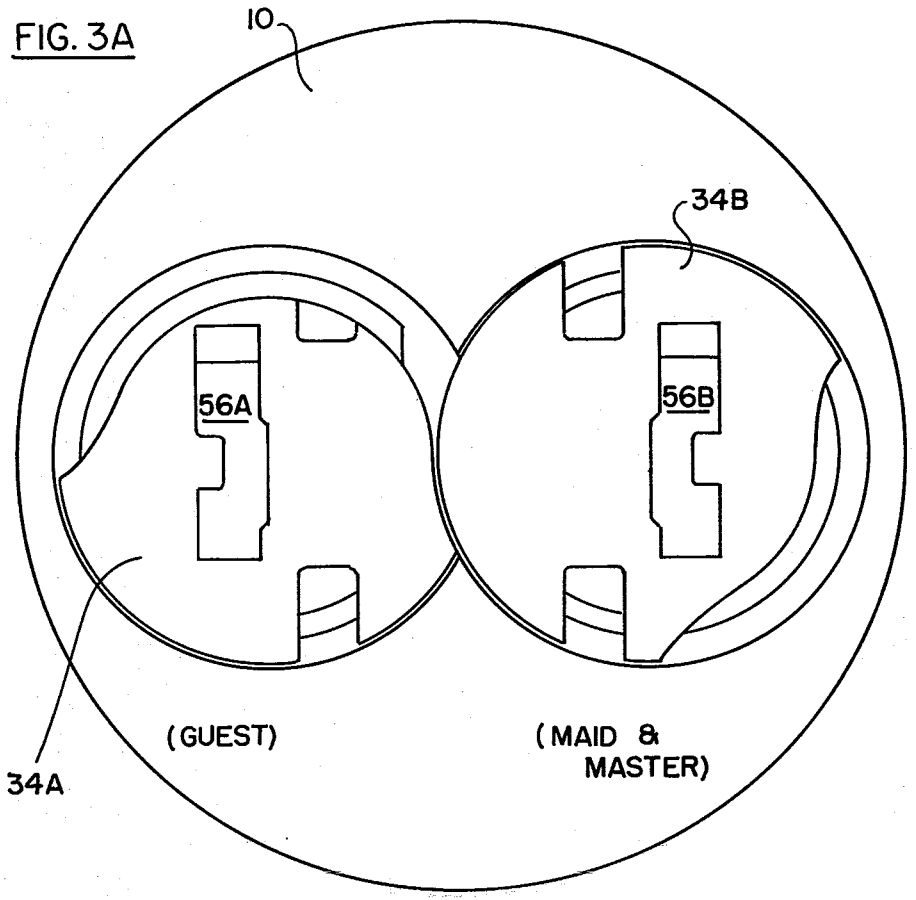
FIG. 3A is a view like FIG. 3, but with the operating plugs inserted into the lock.
Figure 5:
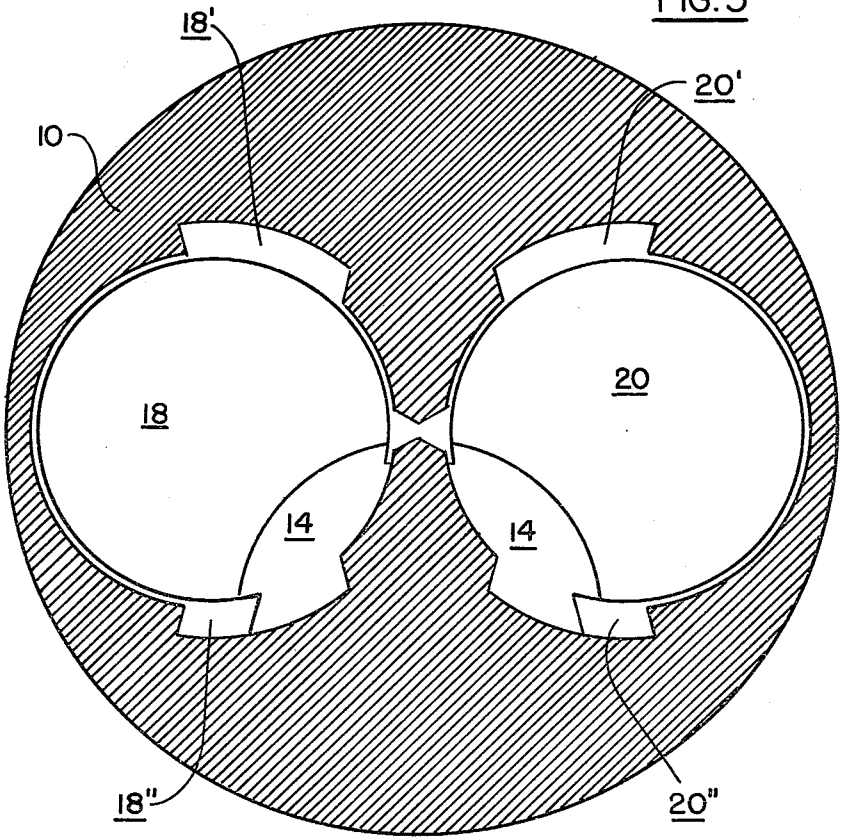
FIG. 5 is a section taken along the line 5—5 of FIG. 2.
Figure 4:
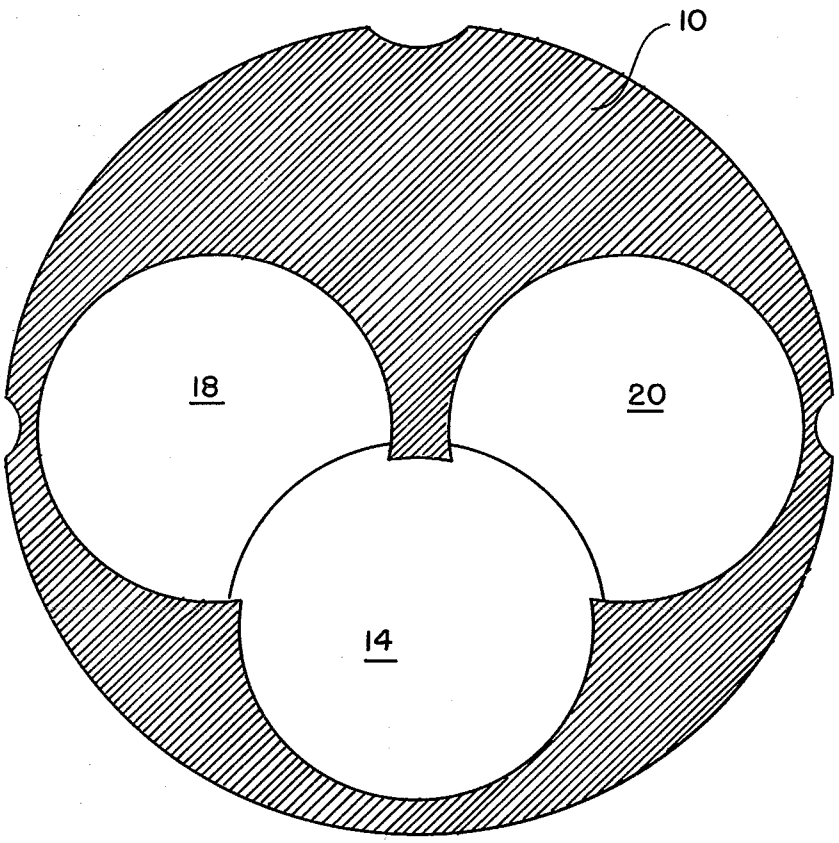
FIG. 4 is a section taken along the line 4—4 of FIG. 2.
Figure 5A:
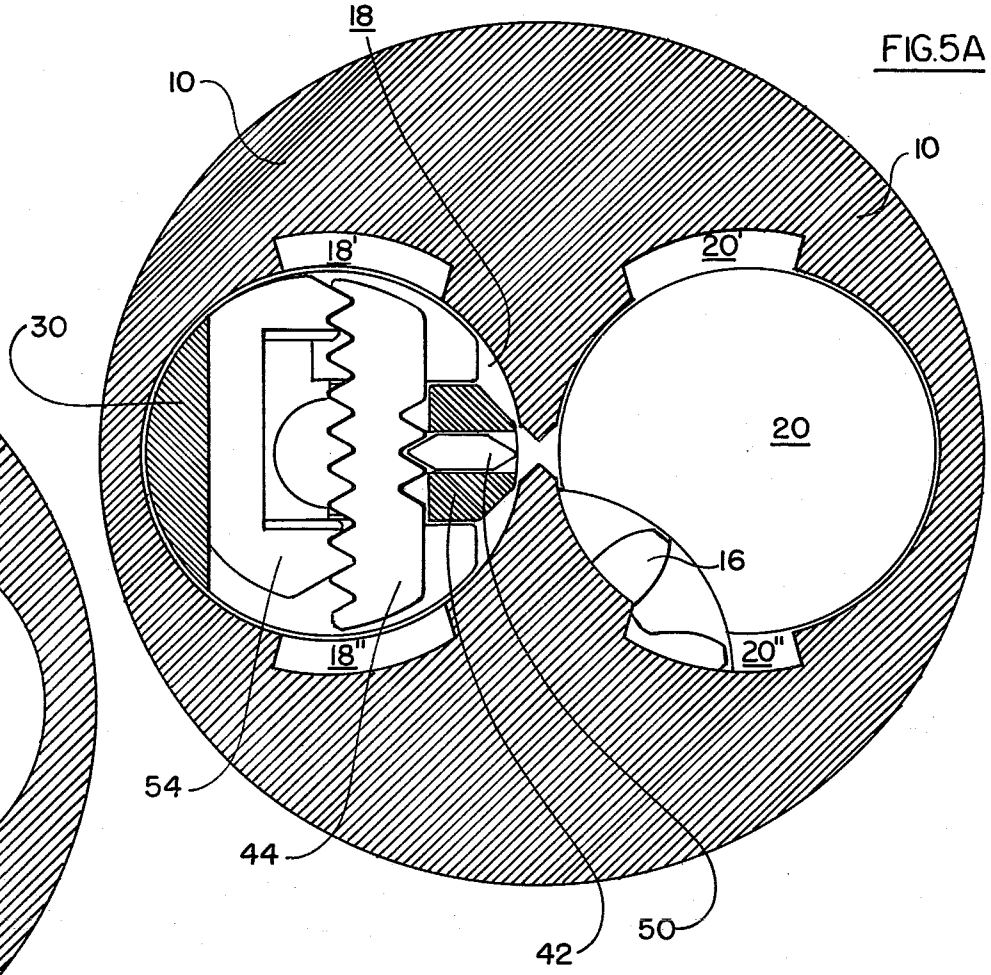
FIG. 5A is a section, like FIG. 5, but with one of the operating plugs in place.
Figure 4A:
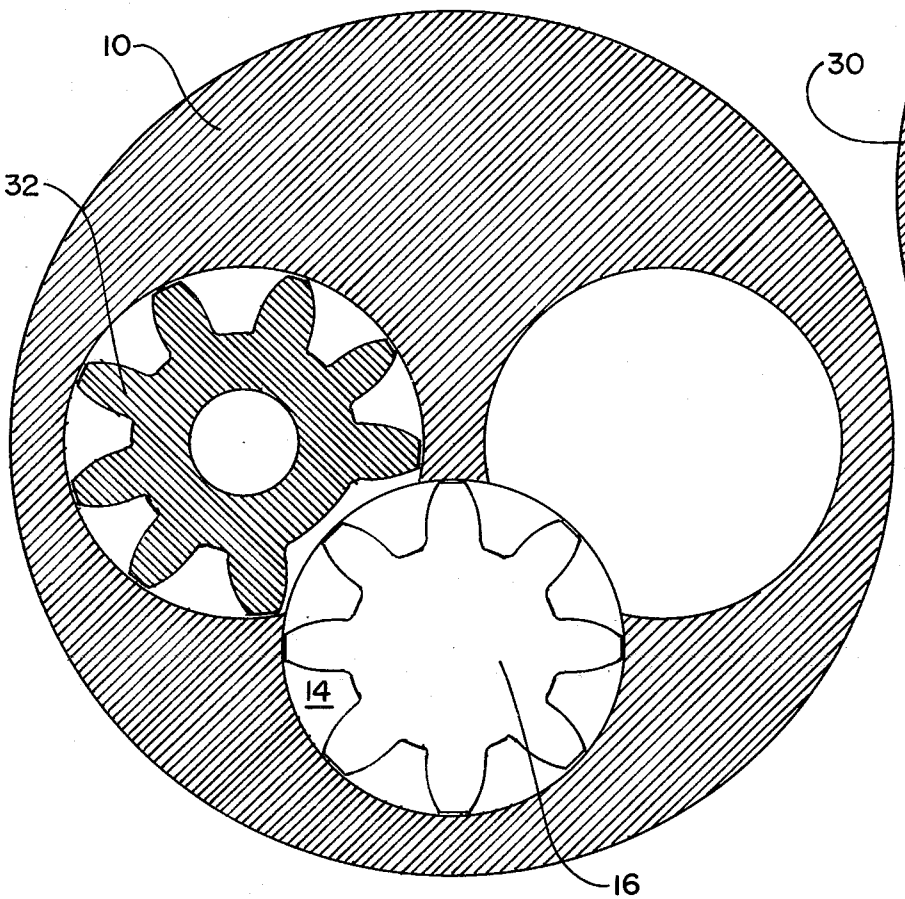
FIG. 4A is a section, like FIG. 4, but with certain of the operating components of the lock assembly in place.

As best shown in FIG. 5, each of the barrels 18 and 20 has a pair of pockets extending along the length thereof, and which are approximately diametrically displaced from one another, these pockets being designated 18', 18" and 20', 20". The operating components of the plug 30 are shown in FIG. 5A, and, as mentioned above, can be similar to the lock assembly described in the copending application Ser. No. 648,176. As shown in FIG. 5A, the plug 30 is rotatably mounted in the barrel 18, and a similar plug is rotatably mounted in barrel 20. The gears 32 of the individual plugs are intercoupled with one another through the gear 16, as shown in FIG. 4A, and the cams 34 of the individual plugs engage one another in the manner shown in FIG. 3A.

The gear train formed by the gears 16 and 32 has a 1:1 ratio. The gear on the plugs have the same number of teeth as the latch controlling gear for a 1:1 gear train ratio, but a gap is provided between two of the teeth on each of the former gears to permit independent operation of the latching controlling gear by the individual barrels. Specifically, each of the gears on the individual plugs has, in the constructed embodiment, eight teeth spaced from one another by equidistant angular amounts, with two of the teeth being spaced from one another by twice the particular angular amount to provide gaps in the two gears so as to permit the desired independent action by the barrels of the latch controlling gear.

A detent 19 is formed in the hub of gear 16 (FIG. 6A), and the detent receives a ball 21. The ball 21 is spring-loaded by a spring 23. The ball assures that the gear 16 will return to its proper reference positions when the keys are withdrawn.

The plug 30 has a series of slots extending radially therethrough, the slots being displaced from one another along the longitudinal axis of the plug. A retainer bar 2 is mounted on the plug 30, and it turns with the plug. When the plug is turned to a resetting position, the retainer bar 42 is received in either the pocket 18' or in the pocket 18". A plurality of elongated wafer-like tumblers 44 are received in the individual slots in plug 30, and are displaced along the plug from one another. The tumblers are slidable in the slots in plug 30 to project beyond the confines of the plug and into the pockets 18' and 18". So long as the tumblers project into the pockets, rotation of the plug 30 is prevented, so that the lock cannot be unlocked.

A pick bar 50 extends the length of plug 30, and is supported in the retainer 42 to be radially movable in the retainer. The pick bar is in the form of a narrow strip, pointed at each edge, as shown. When the plug 30 is in the reference position of FIG. 5A, the pick bar 50 is received in the opening between the barrels 18 nd 20, and is freed from the adjacent serrated edges of the tumblers 44. However, whenever the plug is turned from the reference position, the pick bar 50 engages the serrated edges of the tumblers, preventing any movement of the tumblers except when the plug is in the reference position.

As shown in FIG. 5A, each of the wafer-like tumblers 44 is serrated on both edges. As described, the right-hand edge of each tumbler receives the pick bar 50 when the plug is turned from the reference position so that the tumblers are held securely by the pick bar in the radial positions they occupied before the plug was rotated from the reference position, so that the tumblers cannot thereafter be moved linearly. Therefore, the tumblers cannot be moved radially to feel the unlocked position once the lock has been rotated from the reference position, thereby rendering the lock virtually pick-proof.

Each of the wafer-like tumblers 44 has an associated strip-like key follower 54 in its corresponding slot in the plug 30. Each key follower 54 has matching serrations which engage the serrations on the left-hand edge of each of the tumblers 44 when the lock is in its normal operating position, such as shown in FIG. 5A. The key followers 54 are set to engage the corresponding tumblers 44 at different positions along their length. Then, when the proper key is inserted through the front of the lock and through the flat keyhole 56A in the cam 34A, or flat keyhole 56B in cam 34B (FIG. 3A), and between the key followers 54 and tumblers 44, all the tumblers are withdrawn from the pockets 18' and 18", and the plug may be turned to open the lock.

Should the plug be turned to a resettable position, in which the retainer 42 is received in either the pocket 18' or 18", the key followers 54 are all released from the corresponding wafer-like tumblers 44. However, all of the tumblers 44 are now displaced from the pockets 18' and 18", so that they are held in the plug in their fully retracted position. Now, the current key may be removed, and a new key inserted into the lock. The new key, upon insertion into the lock, instead of moving the tumblers 44, will move the key followers 54 to new positions with respect to the respective tumblers, since the tumblers are now held against linear movement by the inner surface of the barrel, and the key followers are released because the retainer 42 is received in one of the pockets 18' or 18".

When the new key has been inserted, the plug may be turned back by the new key to its normal operating position, such as shown in FIG. 5A, at which the key followers 54 are retained in their new positions along the various tumblers 44 by the retainer 42, as the retainer assumes the angular position shown in FIG. 5A. The lock may now be operated by the new key, which, when inserted, will withdraw the tumblers 44 to their retracted positions out of the pockets 18' and 18", permitting the lock to be operated.

A second plug is inserted in the barrel 20, and it may be similar with the plug in the barrel 18, but it may be reset to accept a different key from the key which operated the plug in barrel 18. When either of the plugs is unlocked, and turned, it is capable of unlocking the door, by virtue of the engagement of its gear 32, with the gear 16, the latter gear being connected to the unlatching mechanism of the door.

However, it is undesirable to permit the individual guests to be capable of resetting the lock. Therefore, the cams 34A and 34B of FIG. 3A are provided, and these cams are shaped so that their peripheral edges interfere with one another so that the guest plug in barrel 18 cannot be turned to its resettable position, because of the peripheral engagement of its cam 34A with cam 34B attached to the maid's plug. However, if the maids plug is barrel 20 is turned to a particular angular position by means of the maid's key, the emergency key, or the program key, the cam 34B releases cam 34A and permits the guest plug to be turned to its resettable position.

Figure 7:
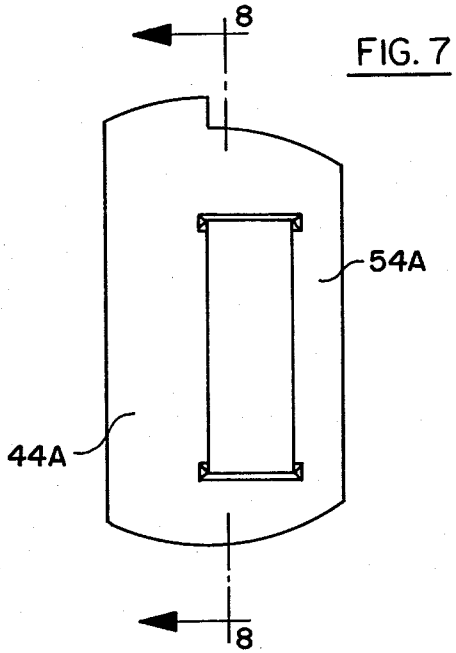
FIG. 7 is a side view of one of the wafer-like tumblers used in the maid's plug which is not resettable.

An additional tumbler 44A (FIG. 7) is provided on which the key follower 54A is not resettable. This additional tumbler is displaced by the maid's key and by the program key into the pocket 20', and the pocket 20' has a limited angular length to permit limited movement of the maid's plug when the maid's key or program key is inserted. This minimum movement is sufficient to permit the maid's key or program key to unlock the door, but is not sufficient to permit either of these keys to turn the maid's plug to a position to pull the dead bolt, should the occupant have the dead bolt in place. This is because standard lock construction is such that a key must turn the plug of the lock past its angular position in which the door latch is pulled to an extreme angular position in order to pull the dead bolt, in the event that the dead bolt has been moved to its locked position. Howver, the emergency key does not shift the tumbler 44A into the pocket 20', so that it is capable of turning the maid's plug in the barrel 20 past the normal position in which the latch is pulled to a position to operate the dead bolt, which is desirable for emergency situations.

Figure 10:
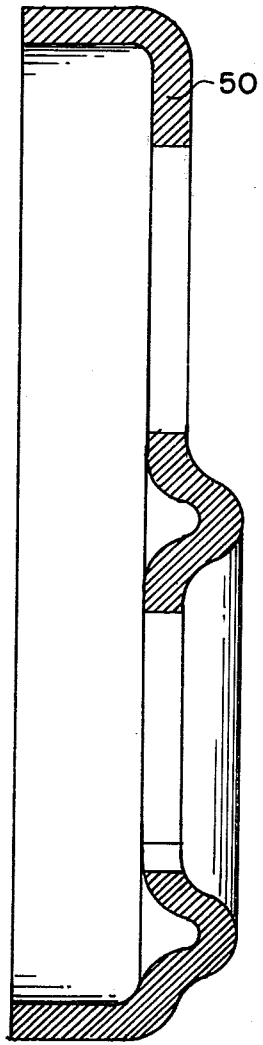
FIG. 10 is a section taken along the line 10—10 of FIG. 9.
Figure 9:
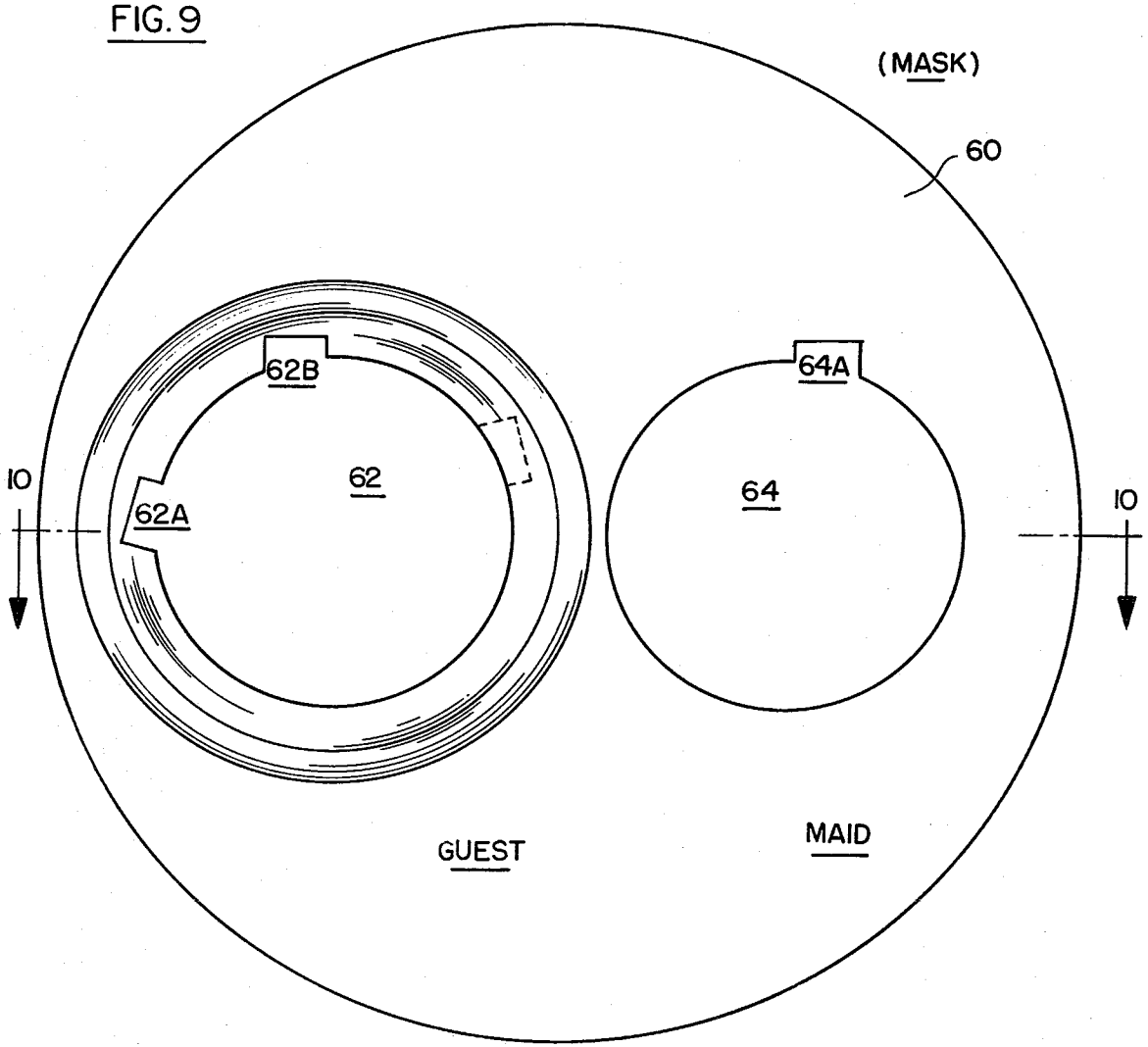
FIG. 9 is an end view of a mask which is intended to be fitted over the front face of the lock.

Even though emergency key and the maid's key can turn the maid's plug in barrel 29 to its resettable position, each is provided with a projection which prevents its withdrawal when the maid's plug in barrel 20 has been turned to its resettable position so that these keys cannot be used to reset the maid's lock. Specifically, a mask 60, as shown in FIGS. 9 and 10 is crimped over the front end of the housing 10, and this mask defines an opening 62 for the guest lock, and an opening 64 for the maid's lock. Opening 64 has a slot 64A which permits the insertion of the maid's key and emergency key, but which prevents either key from being withdrawn when the lock is turned from its normal reference position. However, the program key does not have a projection on it, and it can be inserted into the opening 64, or withdrawn from the opening, for any angular position of the maid's plug. Therefore, the program key can be used to turn the maid's lock to a resettable position at which the program key may be removed, so that the maid's lock may receive a different program key, after which the maid's lock may be returned to its normal position by the new program key, in which it will accept a new maid's key and a new emergency key corresponding to the new program key.

The opening 62 in mask 60 is provided with two slots 62A and 62B which permits the guest key to be inserted and removed for normal operation of the lock, and which also permits the guest key to be removed when the lock is permitted to be turned to its resettable position, so that a new guest key may be inserted to set the guest lock to the new guest key.

While a particular embodiment of the invention has been shown and described, modifications may be made. It is intended in the claims to cover the modifications which come within the true spirit and scope of the invention.

What is claimed is:

1. A lock assembly including: a housing having first and second cylindrical-shaped barrels therein extending longitudinally adjacent to one another from the front of the housing to the rear thereof; first and second plugs rotatably mounted in the respective barrels of the housing; a latch-controlling member rotatably mounted in the housing; means coupling the latch-controlling member to the first and second plugs to permit independent actuation of the latch-controlling member by the individual rotation of the plugs in the housing by first and second keys inserted therein; resettable tumbler means mounted in said first plug, said first plug being turnable in said first cylindrical-shaped barrel to a resettable position in which said resettable tumbler means may be reset by the insertion into the first plug of a key different from said first key; and first and second cam members respectively mounted on the first and second plugs in coaxial relationship therewith and having respective peripheral configurations to engage with one another and prevent the first plug from being turned to its resettable position until the second plug has been turned to a reference position.

2. The lock assembly defined in claim 1, in which the housing has a cylindrical shape.

3. The lock assembly defined in claim 1, in which the latch-controlling member comprises a first gear, and said coupling means comprises second and third gears respectively mounted on the plugs in coaxial relationship therewith and in an intermittent meshing engagement with the first gear to constitute a gear train.

4. The lock assembly defined in claim 3, in which the gear train formed by the first, second and third gears has a 1:1 ratio.

5. The lock assembly defined in claim 3, in which each of the second and third gears has a predetermined number of teeth equidistantly spaced from one another by a predetermined angular amount with two of the teeth spaced from one another by a greater angular amount to permit independent operation of the first and second plugs.

6. The lock assembly defined in claim 5, in which all of the gears of the first gear are equidistantly spaced from one another by a predetermined angular amount, and in which the first, second and third gears all have the same number of teeth.

7. The lock assembly defined in claim 1, in which the second plug has a dead-bolt controlling angular position, and in which said second plug includes further tumbler means operable by the key normally used to operate the second plug so as to prevent the second plug from being turned to said last-named angular position by the key normally used to operate the second plug, but to permit the second plug to be turned to said last-named angular position by means of a special emergency key which does not operate said further tumbler means.

8. The lock assembly defined in claim 1, in which said second plug includes resettable tumbler means, and in which the resettable tumbler means, and in which said first plug may be turned to a resettable position in which said resettable tumbler means may be reset by the insertion therein of a program key different from the second key, and which includes a masking member fitting over the face of the housing to prevent the second key normally used to operate the second plug from being removed when the second plug is in its resettable position, but to permit the programming key to be inserted into and removed from the second plug when the second plug is in its resettable position.

9. The lock assembly defined in claim 7, in which the further tumbler means is not resettable.

10. The lock assembly defined in claim 7, in which the housing includes a cut-out portion for receiving said further tumbler means.

11. The lock assembly defined in claim 3, and which includes a spring-loaded ball mounted in said housing in position to engage a detent in said first gear to return the gear train to a reference position when the first and second keys are withdrawn from the lock assembly.

* * * * *